United States Patent [19]

Pierce et al.

[11] Patent Number: 5,024,028

[45] Date of Patent: Jun. 18, 1991

[54] AIRLESS BLAST CLEANING WHEEL AND HOUSING

[75] Inventors: Kirby L. Pierce, Hartford; Richard C. Kanouse, Dousman, both of Wis.

[73] Assignee: Midwest Blast Products, Inc., Brookfield, Wis.

[21] Appl. No.: 316,552

[22] Filed: Feb. 27, 1989

Related U.S. Application Data

[63] Continuation of Ser. No. 4,378, Jan. 16, 1987.

[51] Int. Cl.[5] ..... B24C 5/06

[52] U.S. Cl. ..... 51/432; 51/410; 51/434

[58] Field of Search ..... 51/410, 432, 433, 434, 51/435, 436, 431

[56] References Cited

U.S. PATENT DOCUMENTS

| | | | |
|---|---|---|---|
| 2,344,989 | 3/1944 | Keefer . | |
| 2,352,588 | 6/1944 | Rosenberger et al. . | |
| 2,708,814 | 5/1955 | Straub . | |
| 3,191,346 | 6/1965 | Chambers . | |
| 3,683,556 | 8/1972 | Leliaert . | |
| 4,064,661 | 12/1977 | Maeda . | |
| 4,176,502 | 12/1979 | Leliat | 51/434 |
| 4,291,509 | 9/1981 | Schulte et al. . | |
| 4,333,278 | 6/1982 | Schulte et al. . | |
| 4,447,993 | 5/1984 | Laido | 51/435 |
| 4,651,477 | 3/1987 | Brucher | 51/434 |
| 4,751,798 | 6/1988 | McDade | 51/434 |

FOREIGN PATENT DOCUMENTS

| | | | |
|---|---|---|---|
| 1652250 | 1/1970 | Fed. Rep. of Germany | 51/432 |
| 2311866 | 10/1973 | Fed. Rep. of Germany | 51/432 |
| 2437493 | 2/1976 | Fed. Rep. of Germany | 51/432 |
| 510681 | 8/1939 | United Kingdom | 51/432 |

*Primary Examiner*—Frederick R. Schmidt
*Assistant Examiner*—Blynn Shideler
*Attorney, Agent, or Firm*—Faegre & Benson

[57] ABSTRACT

An improved airless blast cleaning wheel and housing. The improved cleaning wheel utilizes axially loaded blade holding slots which, through centrifugal force, as the wheel is rotated secure replaceable impeller blades without the use of spring retainers and the like. An improved housing employs a removable front access plate for gaining access to the wheel and related components and incorporates primary and secondary seals to protect a direct drive motor mounted on the housing.

7 Claims, 3 Drawing Sheets

AIRLESS BLAST CLEANING WHEEL AND HOUSING

This application is a continuation of application Ser. No. 07/004,378, filed Jan. 16, 1987.

BACKGROUND OF THE INVENTION

1. Description of the Prior Art

Airless blast cleaning devices have been well known for a considerable period of time. Blast cleaning devices have been manufactured and sold by Wheelabrator-Frye, Inc., 400 South Byrkit Avenue, Mishawaka, Ind. 46544, for a number of years and are described in U.S. Pat. No. 2,708,814, for example, which relate to an airless blast cleaning device utilizing centrifugally thrown abrasives to clean parts by a blast cleaning method.

In existing blast cleaning devices, the Protective housing employs a plurality of replaceable liner elements which serve to redirect the stream of abrasive from the centrifugal wheel to the particular workpiece. In prior art devices, some 21 individual liner elements were required and, even in refinements of that device, some nine replaceable elements were required. Replacement of liner elements is both an expensive and time-consuming procedure and requires substantially complete disassembly of the blast cleaning apparatus.

Additionally, existing blast cleaning devices using centrifugal wheels and replaceable blades require replacement of the blades from time to time. In existing devices, the blades are replaced from the outer edge of the supporting disk and require removal of the existing blade, insertion of a new blade and then the fitting of a specific spring holding device to secure the blade from movement relative to the disk to centrifugal force as the disk is rotated. The specific structure of the prior art wheels require the use of a single size blade with a particular wheel and does not permit freely substituting varying size blades on a common set of disks to provide blast cleaning devices having different characteristics mountable in a common housing assembly.

2. Field or the Invention

This invention relates to cleaning of workpieces utilizing airless blasting techniques. More particularly, this invention relates to apparatus for housing an airless blasting wheel which permits use of a direct drive DC motor to rotate the blasting wheel and which permits easy access to the blasting wheel by removal of a single access plate. Additionally, this invention relates to wheel apparatus capable of accepting varying length blades to provide cleaning devices having differing characteristics utilizing common wheels and housings.

SUMMARY OF THE INVENTION

The present invention is an improved blast cleaning device with an improved housing structure and an improved blasting wheel construction.

The invention comprises a centrifugal blast cleaning system having an impeller blade wheel axially fed with blast cleaning abrasive and incorporating an improved wheel housing, including a front plate having a feed funnel projecting therethrough for delivering abrasive to the access of the cleaning wheel and where the front plate is removable from the remainder of the housing by removal of the faster means to permit access to the wheel.

The cleaning apparatus of this invention is suitable for quick changeover from one size cleaning wheel to another by replacing blades in a common set of blade disks without the necessity of making any changes to the cleaning wheel housing. The reduction in down time, maintenance and changeover down time result in increased efficiency and cost savings.

DETAILED DESCRIPTION OF THE PREFERRED EMBODIMENT

Figures 1, 2:
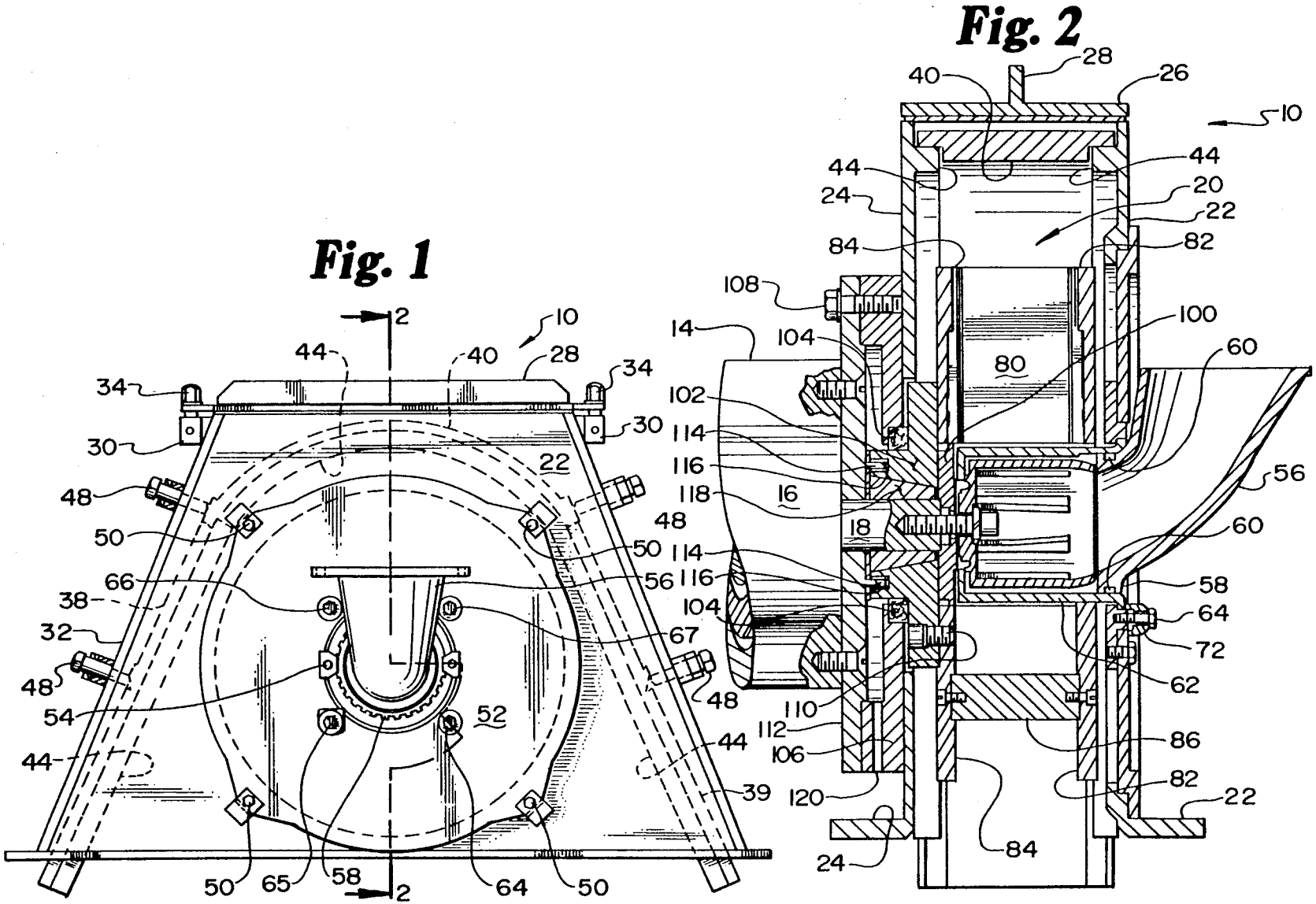
FIG. 1 is a side elevation of the improved blast cleaning wheel assembly.
FIG. 2 is a sectional view of the assembly of FIG. 1 along section lines 2—2.
Figure 3:
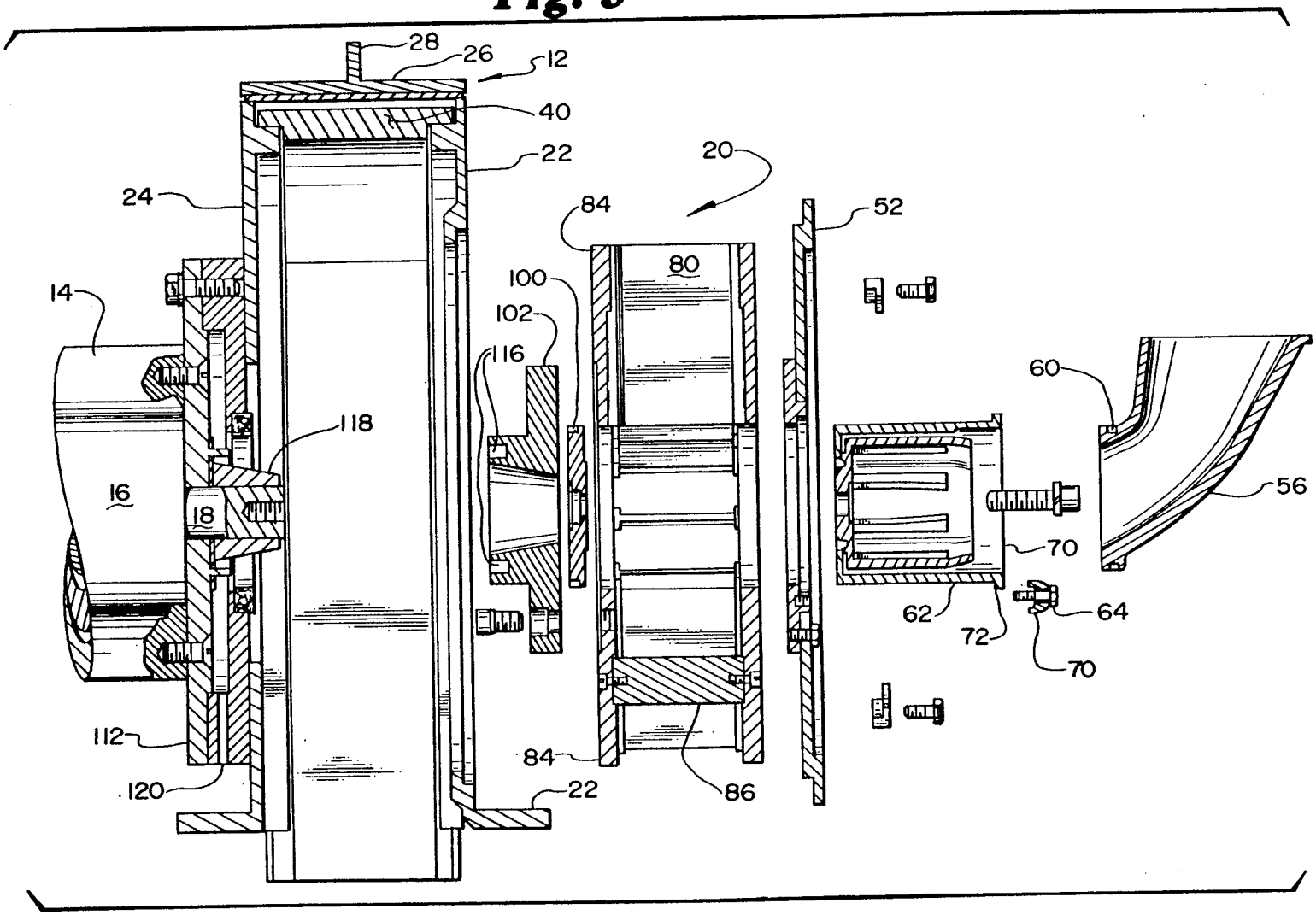
FIG. 3 is an exploded view of the assembly of FIGS. 1 and 2 showing the relationship of the parts.

FIG. 1 is a side elevation view of a centrifugal blast cleaning wheel 10 embodying the present invention. FIG. 2 shows the same wheel 10 in an enlarged sectional view taken along the lines 2—2 in FIG. 1, and FIG. 3 shows the elements in exploded form to clarify their relationship. A wheel guard housing 12, as shown in FIG. 3, is directly connected to the case or housing 14 of a motor 16 which has its output shaft 18 directly connected to drive the blast cleaning wheel 20. Prior art blast cleaning apparatus has utilized a separate transmission, such as a V-belt sheave and spindle drive, to transmit torque from the drive motor to the blast cleaning wheel, at least in part to isolate the motor from the harsh abrasives used in the blast cleaning process. The improved housing disclosed herein includes unique abrasive sealing features which permit the direct connection of motor 16 to the wheel 20 without exposing the motor itself to undue wear and possible damage from the abrasives.

Housing 12 is generally formed from 11-14% manganese alloy to provide resistance to abrasion by the abrasive material used in the blast cleaning process. The housing 14 utilizes a front base plate 22, a rear base plate 24 and a top plate 26, all of which are formed from 11-14% manganese alloy. Top plate 26 has a stiffening rib 28 running longitudinally along its surface. Top plate 26 is secured to tabs 30 projecting from side walls 32. Top plate 26 is secured to tabs 30 by bolts 34.

Because of the extremely highly abrasive nature of the abrasive thrown by wheel 20, it has been necessary for prior centrifugal blast cleaning wheels, such as those made by Wheelabrator-Frye, Inc., in Mishawaka, Ind., to utilize replaceable liner elements within the wheel guard housings in order to avoid destruction of the permanent elements of the wheel guard housing. In the earliest forms of blast cleaning wheels, such liners comprised as many as 21 separate liner parts which had to be periodically replaced. Although that number of liner parts was later reduced to nine elements, replacement of liners is time consuming and expensive. The novel housing design disclosed herein requires the use of only three replaceable liner elements, end liners 38 and 39 and curved top liner 40. Top liner 40 is secured to base plates 22 and 24 by riding upon bars 44 of manganese bonded or secured to the inner surfaces of plates 22 and 24. The liners are held securely in place by the bars 44 and by bolts 48 which bear upon them and hold them in contact with bars 44 as shown.

As distinguished from prior art blast cleaning wheel assemblies, the liners according to the present invention can be readily replaced by first removing bolts 34 and top plate 26 to gain access to top liner 40 which can be released by loosening the top bolts 48. The end liners 38 and 39 can then be released by removal of the lower bolts 48 and the top end liners 38 and 39 and top liner 40 can then be readily replaced and secured without requiring removal of wheel 20.

When it is necessary to gain access to wheel 20, it can be readily done using the unique housing disclosed herein by removing feed funnel 56 and by removing four bolts 50 which secure removable plate 52 to expose wheel 20.

The front access plate includes a projecting flanged portion which partially overlies at least a portion of the housing upon which the front plate is mounted to form a labyrinth seal to prevent abrasive from leaking or escaping outside the housing.

In order to remove funnel 56, it is necessary to remove bolts 54 which secure feed funnel 56 by engaging the flange 58 thereof. Flange 58 has a ring seal for receiving a sealing ring 60 which Projects from flange 58 and engages the inner wall of control cage 62. Control cage 62 is mounted securely on plate 52 utilizing a bolt 64 and a control cage adaptor 70 which engages the annular lip or flange 72 of control cage 62 and secures it to plate 52. Bolt 64 and similar bolts 65, 66 and 67 must be removed prior to removal of plate 52 to gain access to wheel 20.

Mounted within control cage 62 there is an impeller 70 which is rotated with wheel 20 within stationary control cage 72. The interaction of impeller and control cage in blast cleaning machines is shown in U.S. Pat. No. 2,708,814, which is incorporated herein by reference. Abrasive flowing down funnel 56 is propelled through the apertures 74 in impeller 70 and thrown through apertures in the walls of control cage 62 and onto the surface of the wheel blades 80 as wheel 20 is rotated.

Figure 4:
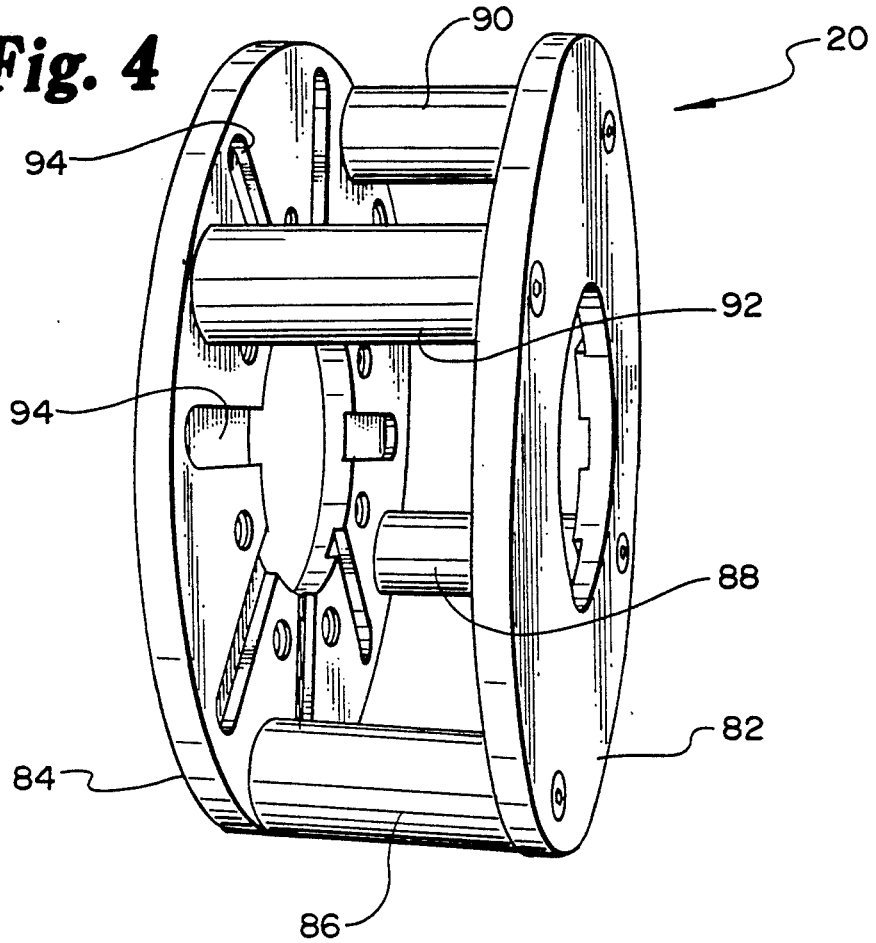
FIG. 4 is a pictorial view of the cleaning wheel.

FIG. 4 shows the structural details of wheel 20. The wheel comprises a pair of side plates 82 and 84 which are separated from each other by cylindrically shaped stand-offs 86, 88, 90 and 92 which are bolted to both plates 82 and 84. A series of blade receiving slots or channels 94 are milled into the inner surfaces of each disk 82 and 84 for receiving blades 80. Slots 94 communicate with the central aperture of disks 82 and 84 so that blades can be installed from the center.

Figure 5:
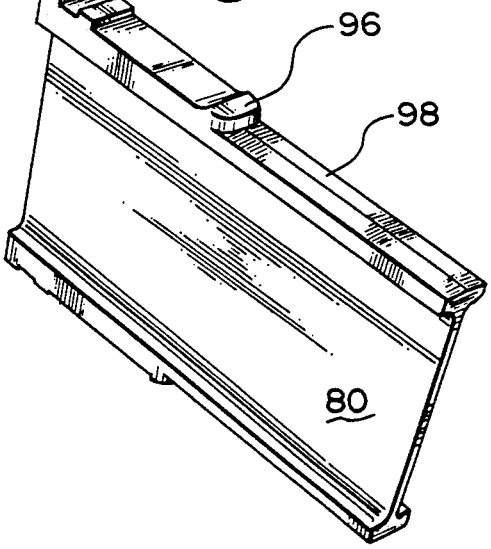
FIGS. 5 and 6 are perspective view of long and short blades for use in the wheel of FIG. 4.
Figure 6:
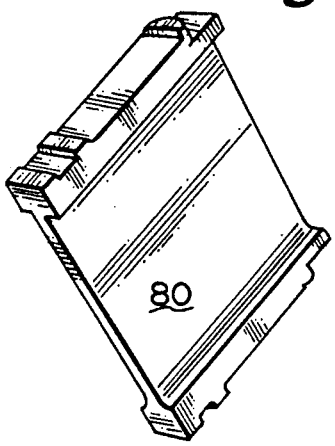

FIG. 5 shows an elongated blade 80, while FIG. 6 shows a shortened form of blade 80, either blade can be inserted in the wheel shown in FIG. 4 and utilized in the housing shown in FIGS. 1 and 2 without other modification because of applicant's novel design. Blades 80 include projecting shoulders 96 which are inserted in slots 94. Because the slots terminate prior to the circumference of disks 82 and 84, they securely hold blades 80 by centrifugal action as wheel 20 is rotated.

The projecting portion 98 of wheel blade 80 as shown in FIG. 5 projects outside the circumference of plates 82 and 84, but is sufficiently strong that it will safely operate without being supported along its entire length by side plate members 82 and 84. Centrifugal force due to rotation of the wheel 20 acts to secure the blades in proper orientation and does not require use of spring holding devices of the type commonly used in prior art blast cleaning wheels which have the blades inserted from the outer portion of the wheel, rather than through the inner aperture, as is the case with the wheel disclosed herein.

The use of high strength manganese for housing plates 22 and 24 minimizes wear from abrasives thrown from the edges of blades 80 where they project beyond the side plates 82 and 84 and eliminates the need for the use of separate removable liners in these areas, as required by prior art devices.

As distinguished from prior art systems where a separate drive transmission is required, wheel 20 is driven by motor 16 directly. A centering plate 100 engages the inner surface of plate 84 and secures it to hub 102 which, in turn, is engaged by a primary hub seal 104 which makes a sealed connection with housing plate 106 which is, in turn, mounted using bolts 108 to housing plate 24. Hub 102 is secured to wheel plate 84 using bolts 110. A secondary labyrinth seal is formed between hub 102 and adaptor plate 112. Adaptor plate 112 has a Projecting plateau or ridge which annularly surrounds the aperture in plate 112 through which shaft 18 of motor 16 projects. A corresponding groove or slot is milled in the surface of hub 102 so that, when the device is connected, the projecting ridge 114 is inserted in the slot 116 in hub 102 to form a secondary labyrinth seal or barrier to movement of abrasive toward the motor shaft. The sealing arrangement of the secondary seal, when combined with the sealing effect of the primary felt hub seal 104, assures that no abrasive material will leave the housing and possibly damage motor 16 or the inner sleeve block 118 of hub 102.

A drain port 120 is provided through plate 106 to allow drainage of any abrasive which migrates past primary seal 104, but is stopped from approaching motor shaft 18 by the secondary labyrinth seal formed cooperation of projection 114 and groove 116.

It will be realized that one skilled in the art may modify the preferred embodiment disclosed herein without departing from the claimed invention.

What is claimed is:

1. In a centrifugal blast cleaning system having an impeller blade wheel axially fed with blast cleaning abrasive, an improvement comprising:

a front access plate means having a feed funnel projecting therethrough for delivering abrasive to the axis of the cleaning wheel, said front access plate means being removable from the remainder of the housing by removal of fastener means, said front access plate means being of sufficiently large dimensions to permit access to and removal of the wheel and to permit access to and insertion and removal of impeller blades;

a motor mounting plate for supporting a motor directly connected thereto and having a motor output shaft receiving aperture therethrough and having an output shaft directly connected to drive the impeller blade wheel and having primary and secondary seals, the secondary seal comprising a metal to metal labyrinth seal, said seals having a separation therebetween positioned between the motor shaft and the interior of the housing, such that the motor is protected from exposure to blast cleaning abrasive;

in combination first and second blade mounting disks held parallel to each other by standoffs, each of said disks bearing on an innerface thereof cooperating channels in the surface thereof for receiving shoulder projections from side edges of impeller blades and supporting the shoulders of the impeller blades in the channels for rotation about the axis of the disks, each of the disks having axial apertures therethrough for feeding abrasive onto the blades when the wheel is rotated, said slots being constructed and arranged for engaging the projecting shoulders on the blades, said slots terminating prior to the circumference of the disks, and said slots thereby centrifugally securing the blades in position as the wheel is rotated; and only three interior replaceable abrasive resistant liner elements.

2. A centrifugal blast cleaning system according to claim 1, wherein the front access plate means includes a projecting flanged portion which partially overlies at least a portion of the housing upon which the front plate is mounted to form a labyrinth seal to prevent abrasive from leaking or escaping outside the housing.

3. A centrifugal blast cleaning system according to claim 1, wherein the primary seal comprises a resilient seal interposed between and in contact with an axial hub of the wheel and the housing and wherein the second seal is a labyrinth seal formed between a projection surrounding the motor shaft on one of the motor mounting plate or the hub and a cooperating indentation on the other of the hub or the motor mounting plate to form a labyrinth seal to prevent migration of any abrasive which passes the first seal and prevents it from reaching the motor shaft by providing a labyrinth passageway.

4. A centrifugal blast cleaning system according to claim 3, wherein a drain is provided to allow abrasive passing the first seal to exit the space between the first and second seals.

5. A centrifugal blast cleaning system according to claim 1, said lines comprising two end liners and one curved top liner.

6. A centrifugal blast cleaning system according to claim 1, wherein the housing is formed from 11–14% manganese alloy.

7. A centrifugal blast cleaning system according to claim 1, wherein the impeller blades may be elongated so that a portion thereof project outside the circumference of the blade mounting disk.

* * * * *